US006450368B1

(12) United States Patent
De LaForcade

(10) Patent No.: US 6,450,368 B1
(45) Date of Patent: Sep. 17, 2002

(54) DEVICE FOR THE EXTEMPORANEOUS MIXING OF AT LEAST THREE PRODUCTS

(75) Inventor: Vincent De LaForcade, Rambouillet (FR)

(73) Assignee: L'Oréal S.A., Paris (FR)

( * ) Notice: Subject to any disclaimer, the term of this patent is extended or adjusted under 35 U.S.C. 154(b) by 0 days.

(21) Appl. No.: 09/953,125

(22) Filed: Sep. 17, 2001

(30) Foreign Application Priority Data

Sep. 15, 2000 (FR) ..... 00 11806

(51) Int. Cl.[7] ..... B67D 5/56

(52) U.S. Cl. ..... 222/129; 222/145.1; 222/145.5; 206/221

(58) Field of Search ..... 222/129, 144.5, 222/145.1, 145.5, 680, 132; 206/219, 221; D9/341

(56) References Cited

U.S. PATENT DOCUMENTS

| | | | | |
|---|---|---|---|---|
| 2,661,871 A | | 12/1953 | Huenergardt | |
| 3,768,697 A | * | 10/1973 | Lerner | 222/145.1 |
| 4,757,916 A | * | 7/1988 | Goncalves | 222/145.1 |
| 5,277,303 A | * | 1/1994 | Groyet et al. | 206/221 |
| 5,647,481 A | * | 7/1997 | Hundertmark et al. | 222/144.5 |
| 5,782,345 A | * | 7/1998 | Guasch et al. | 206/221 |
| 5,908,107 A | * | 6/1999 | Baudin | 222/144.5 |
| D415,959 S | * | 11/1999 | Antoine | D9/341 |
| 6,244,433 B1 | | 6/2001 | Vieu | |

FOREIGN PATENT DOCUMENTS

| | | |
|---|---|---|
| DE | 396 077 | 5/1924 |
| EP | 1 028 069 | 8/2000 |
| EP | 1 033 323 | 9/2000 |
| FR | 983 279 | 6/1951 |
| FR | 2 680 357 | 2/1993 |
| GB | 687 733 | 2/1953 |
| JP | 10-316176 | 1/1998 |

OTHER PUBLICATIONS

English language Derwent Abstract of EP 1 033 323, Sep. 6, 2000.

English language abstract of JP 10–316176, Dec. 2, 1998.

* cited by examiner

*Primary Examiner*—Lesley D. Morris
*Assistant Examiner*—Thach H. Bui
(74) *Attorney, Agent, or Firm*—Finnegan, Henderson, Farabow, Garrett & Dunner, L.L.P.

(57) ABSTRACT

A device for mixing at least three products includes a first container for the separate packaging of at least a first and second product, a second container for storing a third product, and a coupling configured to couple the first and second containers to allow mixture of the first, second, and third products. The first container includes a first compartment configured to contain the first product and a second compartment configured to contain the second product isolated from the first product. The first container also includes a first open portion closed by a first cover and a second open portion closed by a second cover. The first and second open portions each communicate with the first and second compartments. The second container includes a third compartment configured to contain the third product to be mixed with the first and second products, and a dispensing orifice.

47 Claims, 4 Drawing Sheets

DEVICE FOR THE EXTEMPORANEOUS MIXING OF AT LEAST THREE PRODUCTS

Figure 1:
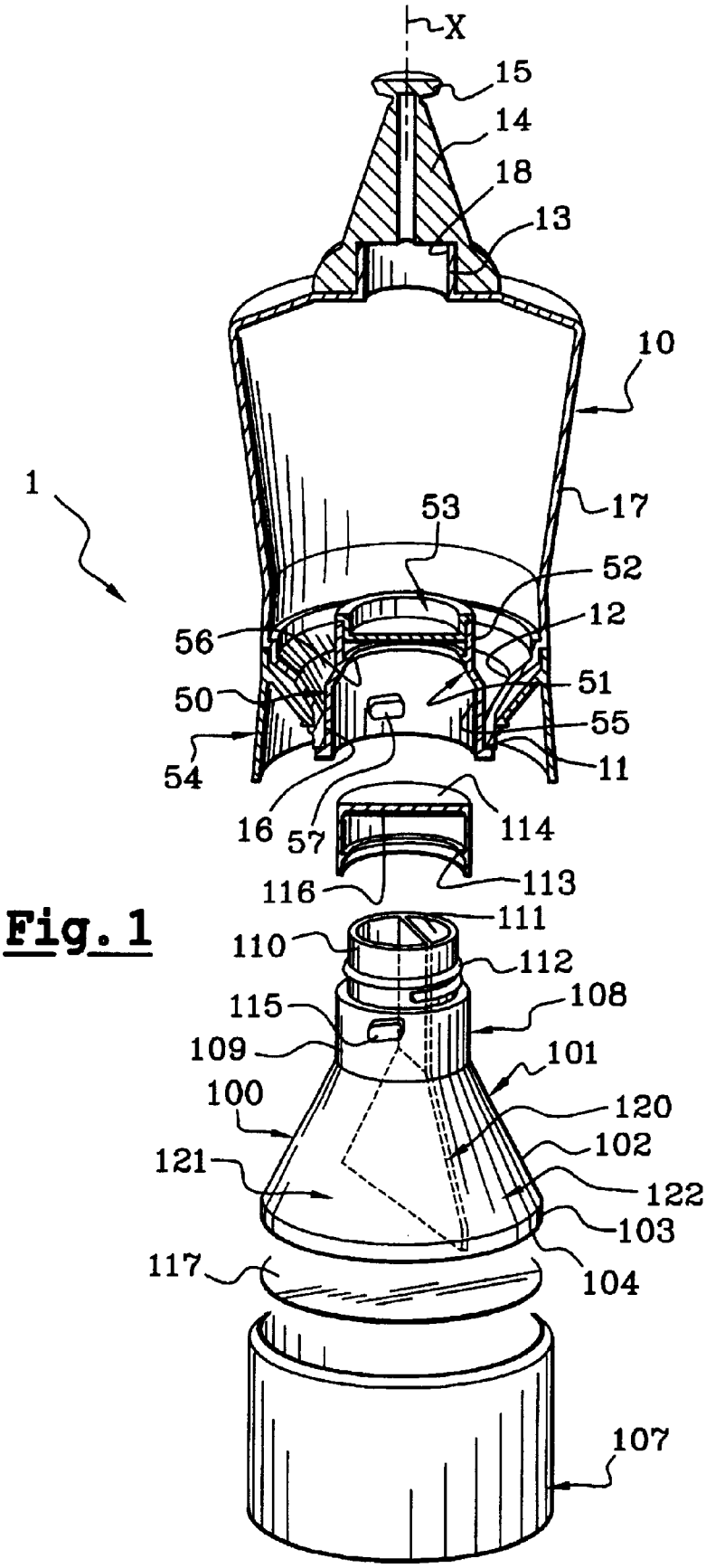

The present invention relates to a device and method for mixing at least three products. The device and method may be particularly suitable for mixing at least two products in powder form with a third product. By way of example, the resultant mixture may form a hair composition, such as a dyeing or permanent-wave composition.

Conventional devices have been used for mixing two products. An example of such a device can be found in FR 2 680 357, which teaches a device having a first bottle designed to contain a first product, connecting means fixed to the base of the first bottle, and a second bottle designed to contain a second product. The first bottle has an open base in the form of a skirt and a dispensing nozzle at the top. The connecting means includes a central sleeve with a separable stopper on one end for closing the first bottle. The second bottle includes a neck engageable with the central sleeve. The neck is provided with a removable closure and drive means. Following removal of the closure, the drive means can engage with complementary means provided on the central sleeve to enable the expulsion of the stopper and to allow the two products to be mixed together.

Other devices for the mixing of three products are disclosed in EP-A-1 033 323 or U.S. Pat. No. 6,244,433.

In the case of hair compositions, new formulas have been developed in which the second product is itself the result of mixing two active agents, notably in the form of powders, which can only be mixed extemporaneously when the composition is about to be used. Consequently the mixing device must be capable of separately packaging three mutually incompatible products and of allowing them to be mixed when the composition is about to be used.

The problem then arises of how to contain two different powders separately, then bring them into contact with each other at the same time as they come into contact with the third product.

Another problem arises of how to introduce powders into the second bottle through the neck of the bottle. The difficulty is that because of the active part played by the neck of the second bottle in expelling the stopper, the cross-section of this neck is necessarily small. Thus, the powders must be introduced into the second bottle by means of tubes and pipes of small cross-section. Such tubes and pipes of small cross-section do not lend themselves to smooth flowing of powders because the powders tend to agglutinate and form plugs. This phenomenon is known as "caking".

Containers for the simultaneous delivery of two separately packaged products are disclosed for example in patents GB-A-687 733, FR-A-983 279, or U.S. Pat. No. 2,661,871.

One of the optional objects of the present invention is to provide a device for mixing at least three products that solves all or some of the problems discussed above with reference to conventional devices.

Another optional object of the invention is to provide a mixing device where the containers that are used for the packaging of the products to be mixed are easy to fill.

A further optional object of the invention is to provide a mixing device that is relatively simple to use and economical to produce.

Yet another optional object of the invention is to provide a device for the mixing at least three products, where two of them may be in the form of powders.

Still other optional objects will become apparent from the following detailed description that follows.

According to an optional aspect of the invention, a device for mixing at least three products may include a first container for the separate packaging of at least two products. The first container may include a first compartment configured to contain a first product and a second compartment configured to contain a second product isolated from the first product. The first container may further include a first open portion closed by a first cover and a second open portion closed by a second cover, wherein the first and second open portions each communicate with the first and second compartments. The device may also include a second container having a third compartment configured to contain a third product to be mixed with the first and second products, and a dispensing orifice. The device may further include a coupling configured to couple the first and second containers to allow mixture of the first, second, and third products.

According to another optional aspect of the invention, a device for mixing at least three products may include a first container having a first end and a second end and a partition within the first container defining at least a first compartment for storing a first product and a second compartment for storing a second product isolated from the first product. The device may include a first open portion at the first end of the first container, the first open portion communicating with the first and second compartments defined by the partition, and a first cover closing the first open portion. The device may further include a second container having a third compartment for storing a third product, a dispensing orifice on the second container, a mixing orifice on the second container, and a removable closure sealing the mixing orifice. The device may further include a coupling configured to couple the first and second containers to allow mixing of the first, second, and third products.

For example, the communication of the first open portion with both compartments might greatly facilitate the contact between the first and second products, which occurs at the same time as they come into contact with the third product. In an exemplary embodiment, the communication of the second opening with each of the compartments might greatly facilitate the filling process.

In another optional aspect of the invention, the area of the second open portion of the first container may be greater than the area of the first open portion. Thus, where the first and second products are in powder form, they might possibly be introduced easily through the second open portion before it is closed with the second cover. When the area of the second open portion is relatively large, the powders might be capable of being introduced through pipes and tubes having cross-sections sufficiently large to avoid the phenomenon of "caking" discussed with reference to conventional systems.

Within the meaning of the present invention, the term "cover" denotes any type of closure. For example, the cover could be connected in any known manner, such as screwed, snap-fastened, adhesively bonded, or welded (e.g., heat sealed).

According to a further optional aspect of the invention, the first and/or second open portions on the first container may be reversibly closed. The cover closing the first open portion may be a threaded cap. In an exemplary embodiment, the device may include a sealing element associated with the first cover and a sealing element associated with the second cover. For example, the sealing elements may be TRISEAL-type seals or any other seals.

The device according to the invention may be made with a variety of materials using any known industrial techniques, such as injection molding.

According to a further optional aspect of the invention, the cross-sectional area of a portion of the first container between the first open portion and the second open portion may decrease progressively towards the first open portion. A profile such as this might allow the first container to be emptied completely when turned upside down in order to produce the mixing of the three products in the second container.

In another optional aspect, the area of the second open portion may be approximately equal to the maximum cross-sectional area of the first container. This might enable maximizing the cross-section of the means useable for filling the first container.

The second cover could be a separately-formed add-on bottom connected to the first container. This connection could be permanent or non-permanent. The second cover is optionally attached to the first container by at least one of screwing, snap-fastening, adhesive bonding, and welding (e.g., heat sealing). By way of example, thermal, ultrasound, or laser welding may be used.

According to yet another optional aspect, the first container may be a single piece of injection molded thermoplastic material chosen from polyethylenes (PE), polypropylenes (PP), polyethylene terephthalates (PET), polyvinyl chlorides (PVC), complexes of polyethylene/ethylene vinyl alcohol (PE/EVOH), and complexes of polyethylene/polyethylene terephthalate (PE/PET). The partition may be formed as part of the single piece injection molding. Other polymeric materials and/or multi-piece arrangements may be used.

The first container may include a partition separating at least the first compartment from the second compartment. Optionally, the partition may extend axially between a first end lying approximately in a plane of the first open portion and a second end lying approximately in a plane of the second open portion.

The partition may be centered on the longitudinal axis of the first container, or off-center, depending on the respective volumes of the first and second products. The first container may have a circular or non-circular cross-section. By way of example, one non-circular cross-section that may be used is an oval cross-section. If the cross-section is oval, the partition may be parallel to the major dimension of the first container, or parallel to the minor dimension. The partition may be arranged so as to define more than two separate compartments.

In a further optional aspect, the device may include a neck on the first container having a free edge defining the first open portion and a sleeve on the second container. The sleeve may have a first end defining a mixing orifice configured to communicate with the third compartment, and a second end defining a coupling orifice, wherein the sleeve is configured to receive the neck through the coupling orifice. The device may further include a removable closure closing the mixing orifice, a first coupling element on the neck, and a second coupling element on the sleeve. In this optional aspect, following removal of the first cover from the first container, coupling of the first and second coupling elements causes removal of the closure from the mixing orifice, allowing the three products to be mixed together. The removable closure may be a stopper force fitted to the mixing orifice. Optionally, the device may include a sealing lip on an inner surface of the sleeve to provide a seal between the sleeve and the neck when the sleeve and the neck are coupled together.

In a further optional embodiment, the dispensing orifice may be at a first end of the second container and the coupling orifice at a second end of the second container opposite to the first end. The dispensing orifice of the second container may be fitted with a nozzle for localized dispensing, such as onto the scalp. Such a nozzle may be provided with a breakable tip.

The first coupling element may optionally include at least one tooth projecting radially outwards on an outer surface of the neck and the second coupling element may include at least one helically sloped portion located on an inner surface of the sleeve and configured to engage the at least one tooth. In a further optional embodiment, the first coupling element may include two diametrically opposite teeth and the second coupling element may include two diametrically opposite helically sloped portions. For example, one or more of the teeth may have a shape like that of a grain of rice.

In one optional aspect of the invention, the first cover may be a cap with threading arranged such that the helically sloped portions have a larger pitch than the threading of the cap. In this optional aspect, rotation of the first container relative to the second container engages the teeth with respective helically sloped portions to axially advance the neck within the sleeve. Optionally, the helically sloped portions may have a pitch such that axial advancement of the neck to a coupled position is brought about by a rotation of less than one revolution of the first container relative to the second container.

In yet another optional aspect, the device may include a first product contained in the first compartment, a second product contained in the second compartment, and a third product contained in the third compartment. In this optional aspect, mixing of the first, second, and third products may form a hair treatment composition. By way of example, the hair treatment composition may be chosen from a dyeing composition and a permanent-wave composition. Optionally, at least one of the first and second products may be in the form of a powder.

In yet another optional aspect of the invention, a method of mixing a hair treatment composition may include providing any of the devices described above, removing the first cover from the first container, coupling the first and second containers, and mixing the first, second, and third products. Optionally, at least one of the first and second products may be in the form of a powder.

Aside from the structural and procedural arrangements set forth above, the invention could include a number of other arrangements, such as those explained hereinafter. It is to be understood that both the foregoing description and the following description are exemplary.

Figure 2A:
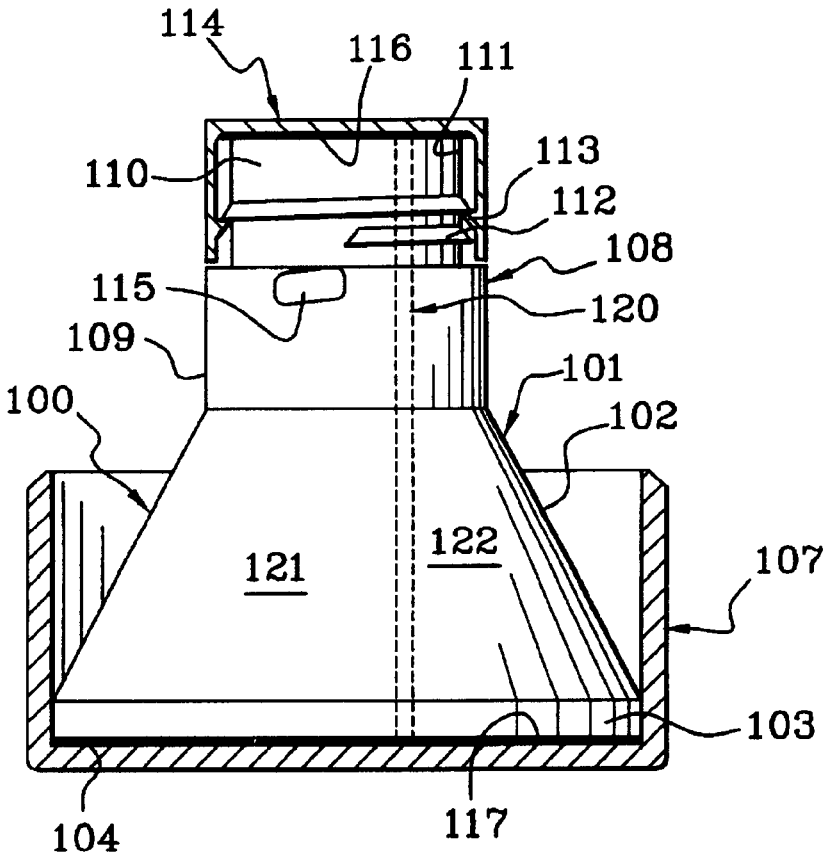
Figure 2B:
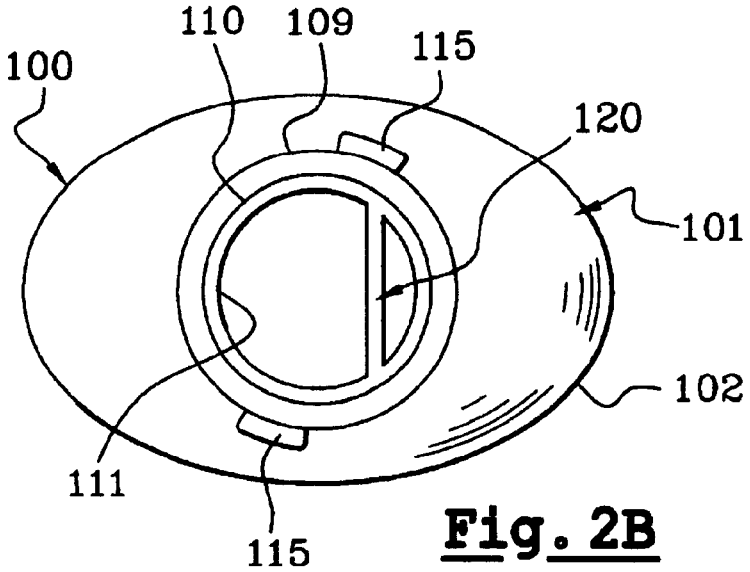

The accompanying drawings are incorporated in and constitute a part of this specification. The drawings illustrate exemplary embodiments of the invention and, together with the description, serve to explain some principles of the invention. In the drawings, FIG. 1 is an exploded view of an optional embodiment of the mixing device according to the invention;

FIGS. 2A–2B illustrate different views of an optional embodiment of the first container used with the mixing device shown in FIG. 1; and FIGS. 3A–3F illustrate optional stages in the use of the mixing device shown in FIG. 1.

The mixing device 1 shown in FIGS. 1 and 2A–2B comprises a first container 100 for separately containing a first product and a second product, which are to be brought simultaneously into contact with a third product contained in a second container 10 to form a mixture. In one embodiment, the first and second products are in the form of powders. The mixture of the first, second, and third products may be a hair treatment composition, such as a dyeing composition or a permanent-wave composition. The first container 100 will be described in detail below, particularly with reference to FIGS. 2A–2B.

As shown in FIG. 1, the second container 10 has a body 17 with an axis X and an open base. A cross-section through the body 17 is generally oval. The base terminates in a collar 11 having a substantially circular cross-section. An opening 16 is defined by a free edge of the collar 11. The collar 11 is connected to the body 17 of the container 10 by a shoulder 12.

A dispensing collar 13 is disposed on a first end of the second container 10. The dispensing collar 13 defines an opening 18 for dispensing the contents of the second container 10. A leakproof dispensing nozzle 14 is secured on the collar 13. The dispensing nozzle 14 is closed with a tip 15 that can be broken off at the time of use to open a passage through the dispensing nozzle 14.

A sleeve 51 having a circular cross-section is disposed within the second container 10. The sleeve 51 is secured in the opening 16 of the collar 11 by force fitting or any other attachment means. An upper part 52 of the sleeve 51 has a reduced cross-section and an end defining a mixing orifice. The mixing orifice is sealed wit leakproof removable closure 53 in the form of stopper formed by a dish. The closure 53 is secured in place by snap-fastening or any other attachment means.

The closure 53 can be separated from the sleeve 51 by a force applied to the closure 53 in the direction of the axis X. When the closure 53 is separated from the sleeve 51, it is freely released into the second container 10.

An inner surface of the sleeve 51 comprises a lip 56, which forms a seal when the first container 100 is coupled with the second container 10, as described below.

The sleeve 51 also includes a lower part 55 with a cross-section greater than the cross-section of the upper part 52. The lower part 55 of the sleeve 51 has an end defining a coupling orifice configured to receive the neck of the first container 100.

A covering skirt 54 having a cross-section comparable to that of the second container 10 is disposed on the second end of the second container. The skirt 54 is secured on the collar 11 by snap-fastening or any other attachment means.

The first container 100 is shown in more detail in FIGS. 2A and 2B, to which reference is now made.

The body 101 of the first container 100 comprises a main part 102, of elongate cross-section increasing progressively towards a shallow cylindrical portion 103 at a second end. A free edge of the cylindrical portion 103 defines a second open portion 104. As described below, after the container 100 has been filled, the second open portion 104 is closed by a second cover 107 in the form of a dish. The second cover 107 is welded or adhesively bonded to the cylindrical part 103 of the first container 100. Other types of attachment means could also be used.

The height of the second cover 107 is greater than the height of the cylindrical portion 103. As shown in FIGS. 3C–3F, when the first container 100 is coupled with the second container 10, a free edge of the second cover 107 is effectively in contact with a corresponding edge of the covering skirt 54.

A neck 108 is formed on the first container at a first end opposite to the second end. The neck 108 has a lower part 109.,of larger cross-section than that of an upper part 110. The upper part 110 has a free edge defining a first open portion 111. A screw thread 112 is provided on the upper part 110 of the neck 108 for engaging with a corresponding thread 113 on a first cover 114. Alternatively, the first open portion 111 of the first container 100 can be closed by a non-threaded cover such as a heat-sealed membrane or any other type of covering. The outside diameter of the first cover 114 is slightly less than the inside diameter of the lower part 55 of the sleeve 51 so that, when the device 1 is in the storage position, shown in FIG. 3A, the cap 114 can be inserted into the sleeve 51.

A partition 120 is formed inside the first container 100 and extends from the plane of the first open portion 111 to the plane of the second open portion 104. The partition 120 extends substantially parallel to the minor axis of the cross-section of the container 100 in a slightly off-centered position. The partition 120 defines two compartments 121, 122 that are isolated from each other when the first cover 114 and the second cover 107 are secured on the first container 100. As shown in FIG. 2A, the compartments 121, 122 extend from the first open portion 111 at the first end to the second open portion 104 at the second end.

A respective sealing element 116, 117 may be placed in the first cover 114 and the second cover 107. A TRISEAL-type sealing element or any other form of sealing means could also be used.

The first and second containers 100, 10 may be formed by injection molding or other known forming processes.

Drive means in the form of two diametrically opposite teeth 115 are located on the lower part 109 of the neck 108. Complementary drive means 571 are provided on the inner surface of the lower part 55 of the sleeve 51. In the embodiment shown, the complementary means 57 comprise two helically sloped portions engageable with respective teeth 115.

The pitch of the helically sloped portions 57 may be greater than the pitch of the threads 112, 113 on the neck 108 and on the first cover 114, respectively. In one embodiment, the pitch of the helically sloped portions 57 is arranged such that rotating the neck 108 less than one revolution relative to the sleeve 51 causes axial movement of the neck 108 relative to the sleeve 51 to enable removal of the closure 53.

The lower part 55 of the sleeve 51 has a larger cross-section than the maximum outside diameter of the thread 112. Thus, the helically sloped portions 57 do not interfere with the thread 112 when the neck 108 is inserted into the sleeve 51 with the first cover 114 removed.

As described above, the first and second products may be introduced into the compartments 121, 122 of the first container 100 through the second open portion 104 before the second cover 107 is secured in place. For example, the first cover 114 is first positioned on the neck 108 and the first container 100 is turned upside down. The first and second products are then introduced through filling pipes inserted into respective compartments 121, 122 through the second open portion 104. Where the first and second products are in powder form, the filling pipes may be sized such that the powder flows easily through them.

The second container 10 is filled with the third product through the opening 18 after the closure 53 is fitted on the mixing orifice and the sleeve 51 is secured in the opening 16 of the collar 11. The dispensing nozzle 14 is then mounted on the dispensing collar 13 of the second container 10.

Figure 3C:
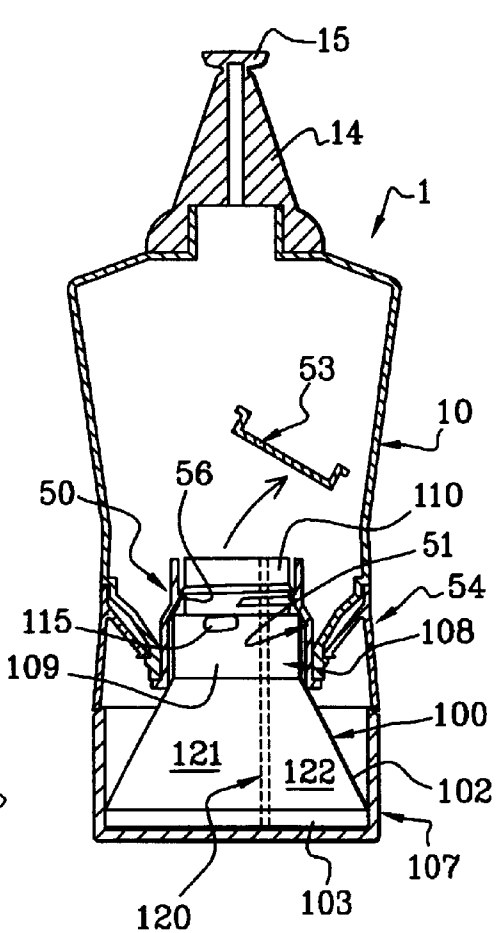

When not in use, the first and second containers 100, 10 may be stored in the coupled configuration. In this configuration, the first cover 114 is secured on the first open portion 111 of the first container 100, and the neck 108 is engaged in the lower part 55 of the sleeve 51, as shown in FIG. 3A. Alternatively, the first and second containers 100, 10 may be stored separately. For example, the containers

100, 10 may be stored side by side in secondary packaging, such as packaging made of board material.

Figure 3B:
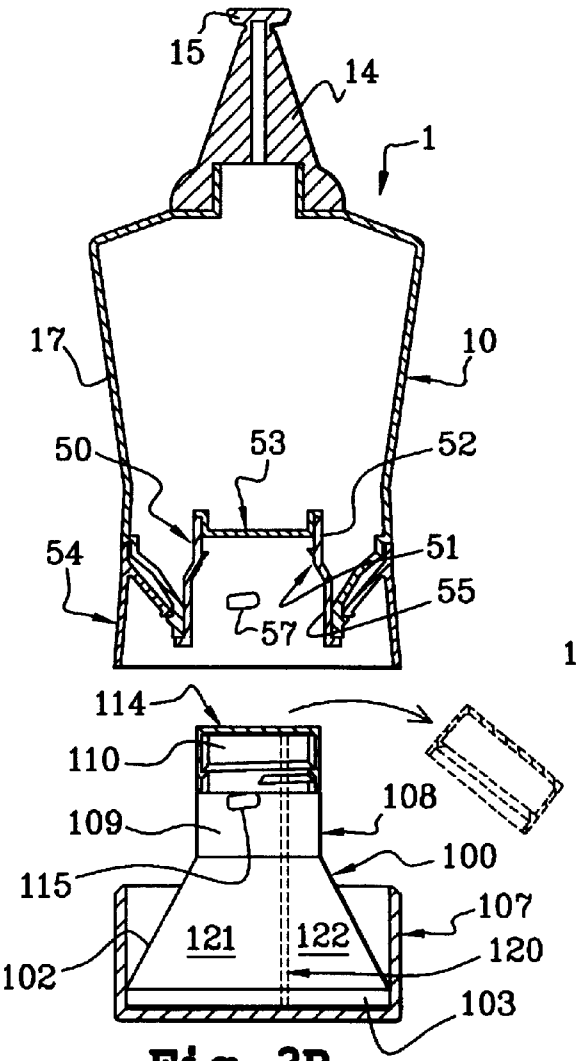
Figure 3A:
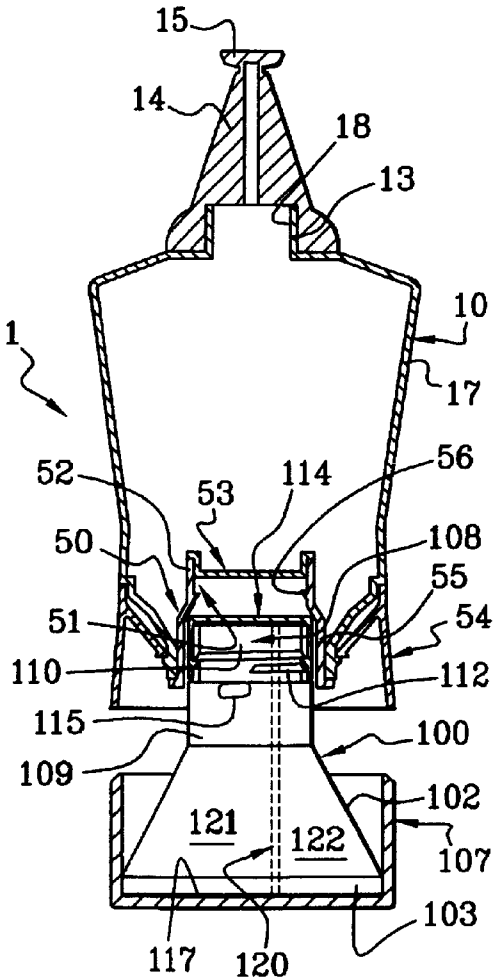
Figure 3F:
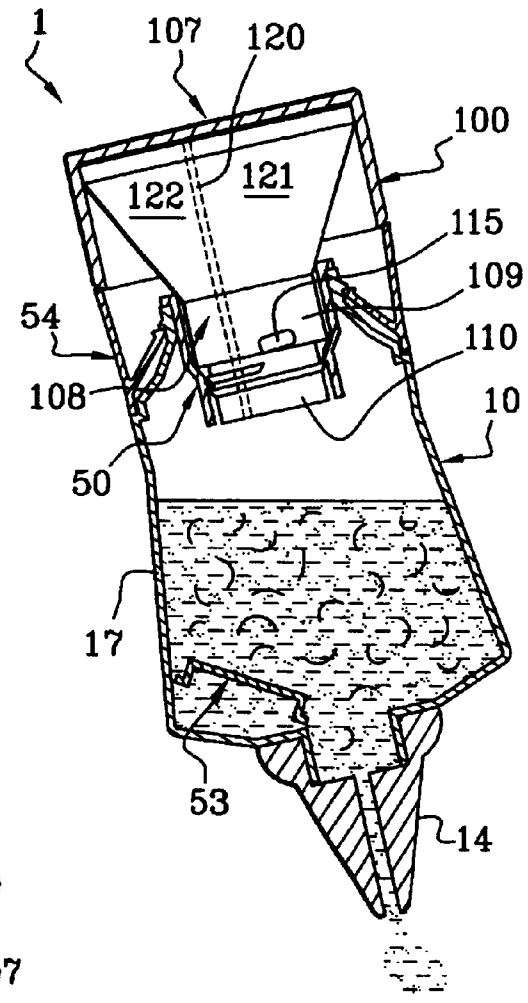

When using the device 1 to mix the three products, a user first withdraws the first container 100 from the sleeve 51 and removes the first cover 114 from the first open portion 111, as shown in FIG. 3B.

The user then inserts the neck 108, with the first cover 114 removed, into the sleeve 51 and pushes the neck inwards axially, rotating it until the teeth 115 engage with the base of the helically sloped portions 57. By rotating the first container 100 relative to the sleeve 51, the user causes the teeth 115 to rise up the helically sloped portions 57. As shown in FIG. 3C, at the end of the upward travel of the teeth 115, the upper part 110 of the neck 108 expels the closure 53 from the mixing orifice, opening the second container 10. An audible sound, such as a "click", may inform the user of the expulsion of the closure 53. In the meantime, the sealing lip 56 has come into leakproof contact with the outer surface of the neck 108. In this position the free edge of the second cover 107 is effectively in contact with the lower edge of the skirt 54.

Figure 3E:
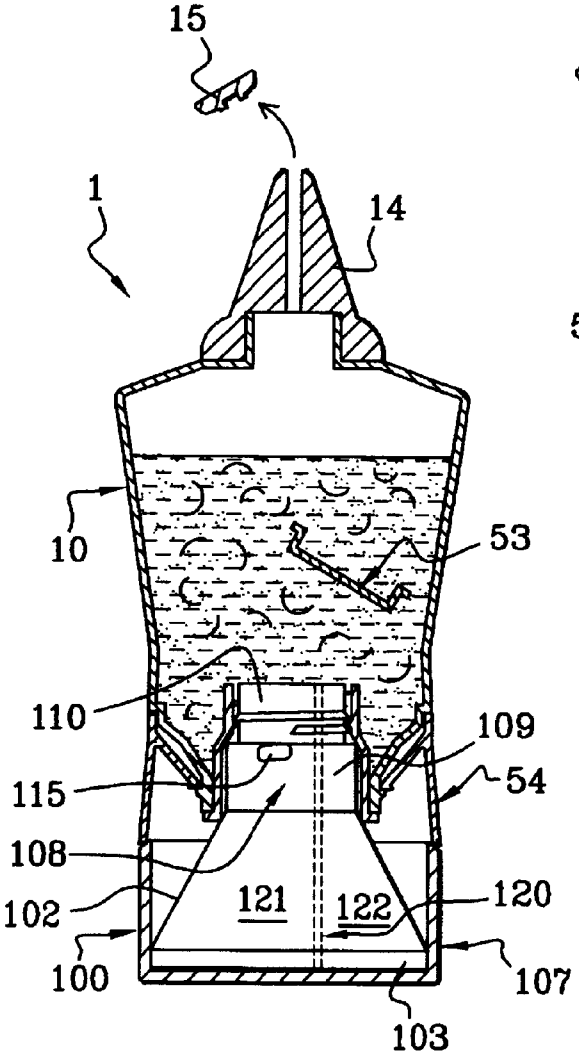
Figure 3D:
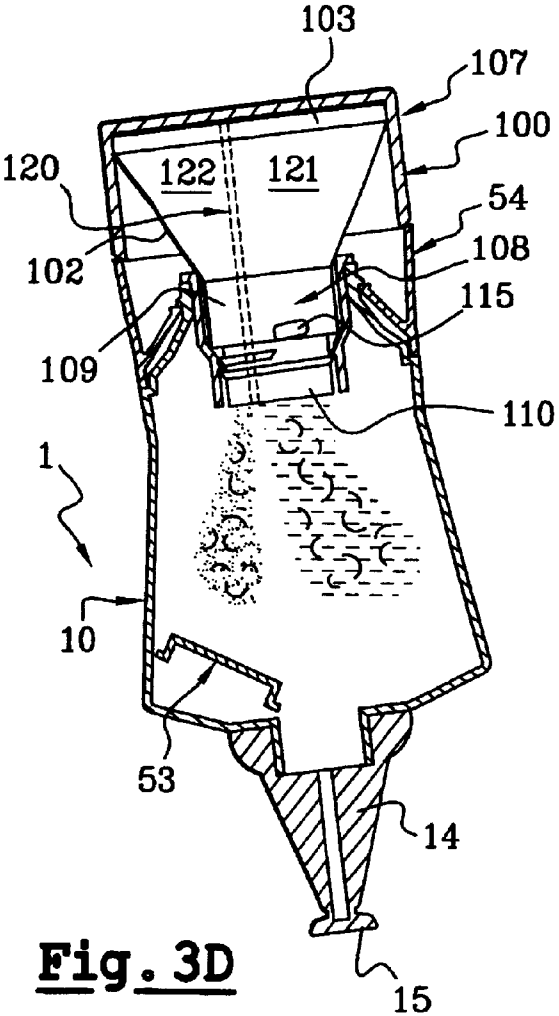

The user then inverts the device 1 so that the first and second products flow into the second container 10, as shown in FIG. 3D. Shaking the coupled containers 100, 10 homogenizes the resulting mixture.

The user may then open the dispensing nozzle 14 by breaking off the tip 15, as shown in FIG. 3E. With the tip 15 removed, the user may apply the mixture to the desired location by holding the device 1 in the inverted position shown in FIG. 3F. For example, when the mixture is a hair treatment product, the nozzle may be used to dispense the product directly onto hair or onto an applicator or even a hand used to place the product into the hair.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for mixing at least three products, the device comprising:

a first container for the separate packaging of at least two products, the first container comprising a first compartment configured to contain a first product, a second compartment configured to contain a second product isolated from the first product, a first open portion closed by a first cover, and a second open portion closed by a second cover, wherein the first and second open portions each communicate with the first and second compartments;

a second container comprising a third compartment configured to contain a third product to be mixed with the first and second products, and a dispensing orifice; and a coupling configured to couple the first and second containers to allow mixture of the first, second, and third products.

2. The device of claim 1, wherein the area of the second open portion of the first container is greater than the area of the first open portion.

3. The device of claim 1, wherein the cross-sectional area of a portion of the first container between the first open portion and the second open portion decreases progressively towards the first open portion.

4. The device of claim 3, wherein the area of the second open portion is approximately equal to the maximum cross-sectional area of the first container.

5. The device of claim 1, wherein the second cover is attached to the first container by at least one of screwing, snap-fastening, adhesive bonding, and welding.

6. The device of claim 1, wherein the first container is a single piece of injection molded thermoplastic material chosen from polyethylenes (PE), polypropylenes (PP), polyethylene terephthalates (PET), polyvinyl chlorides (PVC), complexes of polyethylene/ethylene vinyl alcohol (PE/EVOH), and complexes of polyethylene/polyethylene terephthalate (PE/PET).

7. The device of claim 1, wherein the first cover is a threaded cap.

8. The device of claim 1, wherein the first container further comprises a partition separating at least the first compartment from the second compartment.

9. The device of claim 8, wherein the partition extends axially between a first end lying approximately in a plane of the first open portion and a second end lying approximately in a plane of the second open portion.

10. The device of claim 1, further comprising a sealing element associated with the first cover.

11. The device of claim 1, further comprising a sealing element associated with the second cover.

12. The device of claim 1, further comprising:

a neck on the first container having a free edge defining the first open portion;

a sleeve on the second container, the sleeve having a first end defining a mixing orifice configured to communicate with the third compartment, and a second end defining a coupling orifice, wherein the sleeve is configured to receive the neck through the coupling orifice;

a removable closure closing the mixing orifice;

a first coupling element on the neck; and a second coupling element on the sleeve, wherein the first coupling element and the second coupling element are configured to be coupled to one another following removal of the first cover from the first container, and wherein the coupling of the first and second coupling elements causes removal of the closure from the mixing orifice, allowing the three products to be mixed together.

13. The device of claim 12, wherein the dispensing orifice is at a first end of the second container and the coupling orifice is at a second end of the second container opposite to the first end.

14. The device of claim 12, wherein the removable closure is a stopper force fitted to the mixing orifice.

15. The device of claim 12, further comprising a sealing lip on an inner surface of the sleeve to provide a seal between the sleeve and the neck when the sleeve and the neck are coupled together.

16. The device of claim 12, wherein the first coupling element comprises at least one tooth projecting radially outwards on an outer surface of the neck, and the second coupling element comprises at least one helically sloped portion located on an inner surface of the sleeve and configured to engage the at least one tooth.

17. The device of claim 16, wherein the first coupling element comprises two diametrically opposite teeth, and the second coupling element comprises two diametrically opposite helically sloped portions.

18. The device of claim 17, wherein the first cover is a cap, the cap comprising threading arranged such that the helically sloped portions have a larger pitch than the threading of the cap.

19. The device of claim 18, wherein rotation of the first container relative to the second container engages the teeth with respective helically sloped portions to axially advance the neck within the sleeve.

20. The device of claim 19, wherein the helically sloped portions have a pitch such that axial advancement of the neck to a coupled position is brought about by a rotation of less than one revolution of the first container relative to the second container.

21. The device of claim 1, further comprising a first product contained in the first compartment, a second product contained in the second compartment, and a third product contained in the third compartment, wherein mixing of the first, second, and third products forms a hair treatment composition.

22. The device of claim 21, wherein the hair treatment composition is chosen from a dyeing composition and a permanent-wave composition.

23. The device of claim 21, wherein at least one of the first and second products is in the form of a powder.

24. The device of claim 1, further comprising a first product contained in the first compartment, a second product contained in the second compartment, and a third product contained in the third compartment, wherein at least one of the first and second products is in the form of a powder.

25. A method of mixing a hair treatment composition, comprising:

providing the device of claim 1;

removing the first cover from the first container;

coupling the first and second containers; and mixing the first, second, and third products.

26. The method of claim 25, wherein at least one of the first and second products is in the form of a powder.

27. A device for mixing at least three products, the device comprising:

a first container having a first end and a second end;

a partition within the first container defining at least a first compartment for storing a first product and a second compartment for storing a second product isolated from the first product;

a first open portion at the first end of the first container, the first open portion communicating with the first and second compartments defined by the partition;

a first cover closing the first open portion;

a second container having a third compartment for storing a third product;

a dispensing orifice on the second container;

a mixing orifice on the second container;

a removable closure sealing the mixing orifice; and a coupling configured to couple the first and second containers to allow mixing of the first, second, and third products.

28. The device of claim 27, further comprising a second open portion at the second end of the first container, and a second cover closing the second open portion, wherein the second open portion communicates with the first and second compartments.

29. The device of claim 28, wherein the area of the second open portion of the first container is greater than the area of the first open portion.

30. The device of claim 28, wherein the cross-sectional area of a portion of the first container between the first open portion and the second open portion decreases progressively towards the first open portion.

31. The device of claim 30, wherein the area of the second open portion is approximately equal to the maximum cross-sectional area of the first container.

32. The device of claim 28, wherein the second cover is attached to the first container by at least one of screwing, snap-fastening, adhesive bonding, and welding.

33. The device of claim 28, further comprising a sealing element associated with the second cover.

34. The device of claim 27, further comprising a sealing element associated with the first cover.

35. The device of claim 27, wherein the first cover is a threaded cap.

36. The device of claim 27, wherein the partition extends axially between a first end lying approximately in a plane of the first open portion and a second end lying approximately in a plane of the second open portion.

37. The device of claim 27, wherein the removable closure is a stopper force fitted to the mixing orifice.

38. The device of claim 27, further comprising:

a neck on the first container having a free edge defining the first open portion;

a sleeve on the second container, the sleeve having a first end defining the mixing orifice configured to communicate with the third compartment, and a second end defining a coupling orifice, wherein the sleeve is configured to receive the neck through the coupling orifice;

a first coupling element on the neck; and a second coupling element on the sleeve, wherein the first coupling element and the second coupling element are configured to be coupled to one another following removal of the first cover from the first container, and wherein the coupling of the first and second coupling elements causes removal of the closure from the mixing orifice, allowing the three products to be mixed together.

39. The device of claim 38, wherein the dispensing orifice is at a first end of the second container and the coupling orifice is at a second end of the second container opposite to the first end.

40. The device of claim 38, further comprising a sealing lip on an inner surface of the sleeve to provide a seal between the sleeve and the neck when the sleeve and the neck are coupled together.

41. The device of claim 38, wherein the first coupling element comprises at least one tooth projecting radially outwards on an outer surface of the neck, and the second coupling element comprises at least one helically sloped portion located on an inner surface of the sleeve and configured to engage the at least one tooth.

42. The device of claim 27, further comprising a first product contained in the first compartment, a second product contained in the second compartment, and a third product contained in the third compartment,.wherein mixing of the first, second, and third products forms a hair treatment composition.

43. The device of claim 42, wherein the hair treatment composition is chosen from a dyeing composition and a permanent-wave composition.

44. The device of claim 42, wherein at least one of the first and second products is in the form of a powder.

45. The device of claim 27, further comprising a first product in the first compartment, a second product in the second compartment, and a third product in the third compartment, wherein at least one of the first and second products is in the form of a powder.

46. A method of mixing a hair treatment composition, comprising:

providing the device of claim 27;

removing the first cover from the first container;

coupling the first and second containers; and mixing the first, second, and third products.

47. The method of claim 46, wherein at least one of the first and second products is in the form of a powder.

* * * * *